United States Patent [19]

Cressey et al.

[11] Patent Number: 4,993,492

[45] Date of Patent: Feb. 19, 1991

[54] METHOD OF INSERTING WIRELINE EQUIPMENT INTO A SUBSEA WELL

[75] Inventors: John F. Cressey, Southwell, England; Ian J. Hardy, Banchory, Scotland

[73] Assignee: The British Petroleum Company, p.l.c.c, London, England

[21] Appl. No.: 532,106

[22] Filed: Jun. 1, 1990

Related U.S. Application Data

[63] Continuation of Ser. No. 262,132, Oct. 25, 1988, abandoned, which is a continuation of Ser. No. 792,711, Oct. 30, 1985, abandoned.

[30] Foreign Application Priority Data

Nov. 13, 1984 [GB] United Kingdom ..... 28633

[51] Int. Cl.[5] ..... E21B 33/076

[52] U.S. Cl. ..... 166/339; 166/70; 166/351

[58] Field of Search ..... 166/338, 339, 351, 359, 166/360, 385, 77, 85, 70, 342, 379, 380, 75.1

[56] References Cited

U.S. PATENT DOCUMENTS

| | | | |
|---|---|---|---|
| 2,211,206 | 8/1940 | Howard | 166/77 |
| 2,721,614 | 10/1955 | Simmons | 166/77 |
| 2,810,442 | 10/1957 | Tausch | 166/77 |
| 3,311,063 | 3/1967 | Grable | 166/359 |
| 3,500,907 | 3/1970 | Gentry | 166/70 |
| 3,517,736 | 6/1970 | Waldron | 166/77 |
| 3,532,163 | 10/1970 | Ecuer | 166/84 |
| 3,556,209 | 1/1971 | Reistle, III et al. | 166/70 |
| 3,602,300 | 8/1971 | Jaffe | 166/351 |
| 3,637,009 | 1/1972 | James | 166/77 |
| 3,825,065 | 7/1974 | Lloyd et al. | 166/351 |
| 4,076,079 | 2/1978 | Herricks et al. | 166/75.1 |
| 4,260,022 | 4/1981 | Van Bilderbeek | 166/339 |
| 4,331,203 | 5/1982 | Kiefer | 166/68 |
| 4,489,780 | 12/1984 | Duhon | 166/70 |
| 4,667,986 | 5/1987 | Johnson et al. | 285/24 |
| 4,673,041 | 6/1987 | Turner et al. | 166/340 |

FOREIGN PATENT DOCUMENTS

| | | | |
|---|---|---|---|
| 2000826 | 1/1979 | United Kingdom | 166/70 |

OTHER PUBLICATIONS

Miffre et al., "Operation Snubbing Sur le Champ Sous-Marin de Grondin N.E.-Elf Gabon", Dec. 1981, 7 pages.

*Primary Examiner*—Hoang C. Dang
*Attorney, Agent, or Firm*—Morgan & Finnegan

[57] ABSTRACT

A subsea wireline lubricator comprises in sequence (a) a stuffing box, (b) at least one blow-out preventer, (c) a riser, (d) a foot valve and (e) a connector for connection to a subsea well head assembly.

The lubricator permits wireline access to subsea oil wells without the need for a conventional tensioned riser.

1 Claim, 2 Drawing Sheets

METHOD OF INSERTING WIRELINE EQUIPMENT INTO A SUBSEA WELL

Figure 1:
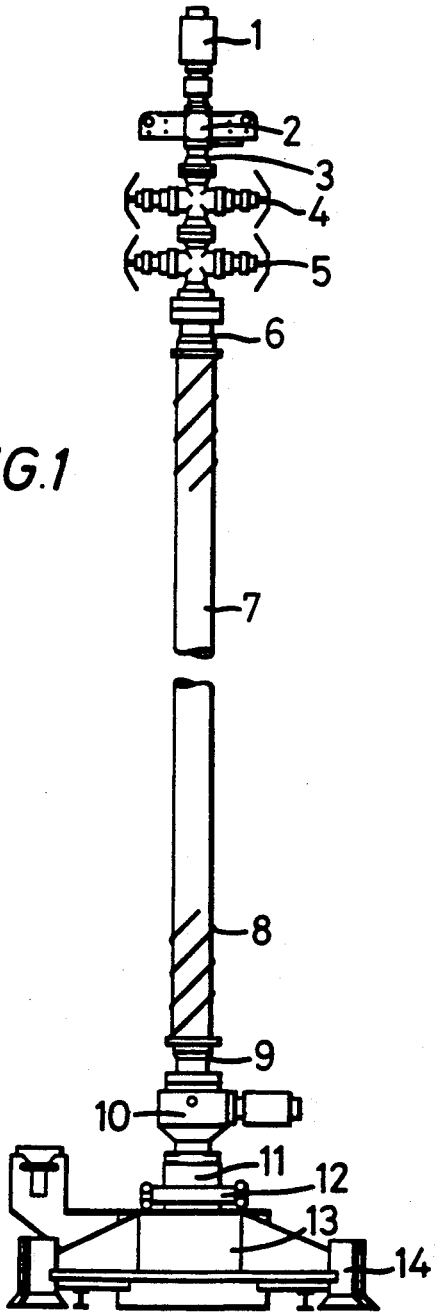

This is a continuation of co-pending application Ser. No. 07/262,132, filed on Oct. 25, 1988, now abandoned, which is a continuation of Ser. No. 792,711, filed Oct. 30, 1985, abandoned.

This invention relates to a subsea wireline lubricator.

During the drilling, testing and operation of an oil well it is sometimes necessary to insert and/or withdraw instruments such as well logging instruments, to deploy tools, e.g. "fishing" tools, and to replace equipment such as down-hole safety valves, pressure plugs, etc.

These operations are often carried out by the technique known as wirelining in which specially designed equipment is lowered down the well suspended from a solid or braided wire.

Wirelining as such is a reasonably straightforward operation in onshore operations where access to the well is readily available through a conventional "Christmas tree" well head at the earth surface.

Offshore production may be carried out from fixed platforms resting on the sea bed or from semi-submersible or floating platforms or vessels which are capable of some degree of movement.

Fixed platforms generally have several individual well risers rising from the sea bed to well head completion equipment on the platform and are similar to onshore locations in that access to the wells for wirelining operations is readily available.

In respect of semi-submersible and floating platforms and vessels, however, wells are generally completed on the sea bed and manifolded to a production riser system or in the case of satellite wells may be remote from the production facility and tied back with flowlines and risers. Thus, immediate access to these wells from the surface is not normally available.

Access can be made available by fitting a tensioned riser back to the surface, but this is difficult, time consuming and expensive and may involve considerable loss of production. One method by which this can be achieved when the well is in close proximity with a movable production platform or vessel is to move the latter so that it is positioned with its moon pool or similar facility positioned directly above the well scheduled for wirelining. Another, which is more suitable for satellite wells, involves the temporary use of a drilling or workover vessel.

Both methods involve the use of a tensioned riser supported from the surface on which conventional surface lubricator equipment is mounted.

We have devised equipment which enables access to be gained to subsea wells for wirelining operations without requiring riser access from the surface. This equipment is hereinafter termed a subsea wireline lubricator.

Thus according to the present invention there is provided a subsea wireline lubricator which comprises in sequence (a) means for entry, (b) at least one blow-out preventer, (c) a riser, (d) a foot valve and (e) a connector for connection to a subsea well head assembly.

Adapter spools may be required in places because of differences in diameter between adjacent components of the lubricator. However, if adjacent sections have the same diameter, then an adapter spool is not necessary.

A suitable means for entry is a stuffing box, which provides pressure containment during wireline operations.

Preferably the stuffing box can be remotely latched and unlatched by hydraulic power to allow entry and removal of equipment into the lubricator.

The blow-out preventer should comprise both blind and shear rams. Preferably two blow-out preventers are employed.

The riser may be strengthened by making it a composite structure with an inner tool carrying tube and an outer casing.

The foot valve is suitably a gate valve.

A lifting bar is preferably provided for ease of handling and is most preferably located between the entry means and the blow-out preventer.

Preferably a cross-over spool is fitted beneath the foot valve and the latter is rotatable so that access to either bore of a dual completion well is obtainable by correct orientation.

The riser should be of sufficient length to accommodate the longest tool string which is likely to be inserted. In current practice this is approximately 12.5 m.

It should be noted that the riser is situated between a blow-out preventer and the foot valve. In this way it is always possible to isolate the well even if wireline tools become stuck in any position.

A fishing section comprising an upper riser, dimensioned to accommodate a fishing tool, can be interposed between the entry means and the blow-out preventer, if desired.

In use, the subsea wireline lubricator will be a free standing structure connected to a subsea wellhead assembly with the blow-out preventer and entry means uppermost.

Control of all lubricator and wellhead functions will normally be hydraulic via an umbilical. A second umbilical may be provided to flush the lubricator free from hydrocarbons before opening the means for entry, e.g. the stuffing box, and removing the equipment.

The complete subsea wireline lubricator will usually be positioned by running on a winch line down guide wires attached to the posts of a standard API tree frame.

It is considerably smaller and lighter than conventional tensioned riser systems and its assembly and deployment is much quicker. The major advantage, however, lies in the fact that wirelining operations may be carried out without prolonged field shutdowns where these were previously necessary.

The subsea wireline lubricator can be operated from a specially equipped Dive Support Vessel (DSV).

According to another aspect of the present invention there is provided a method for inserting wireline equipment into a subsea oil well which method comprises the steps of (a) connecting a subsea wireline lubricator as hereinbefore described to the subsea well head, (b) closing the foot valve, if not already closed, (c) opening the entry means if not already open, (d) opening the blow-out preventer(s), if not already open, (c) inserting the equipment through the entry means and the blow-out preventer(s) into the riser section, (f) closing the entry means, (g) pressure testing, (h) opening the foot valve and (i) lowering the equipment through the valve and into the well.

The above procedure is reversed when it is desired to recover the equipment, with the additional feature that the lubricator may be flushed free from hydrocarbons before opening the entry means to remove the equipment.

Figure 2:
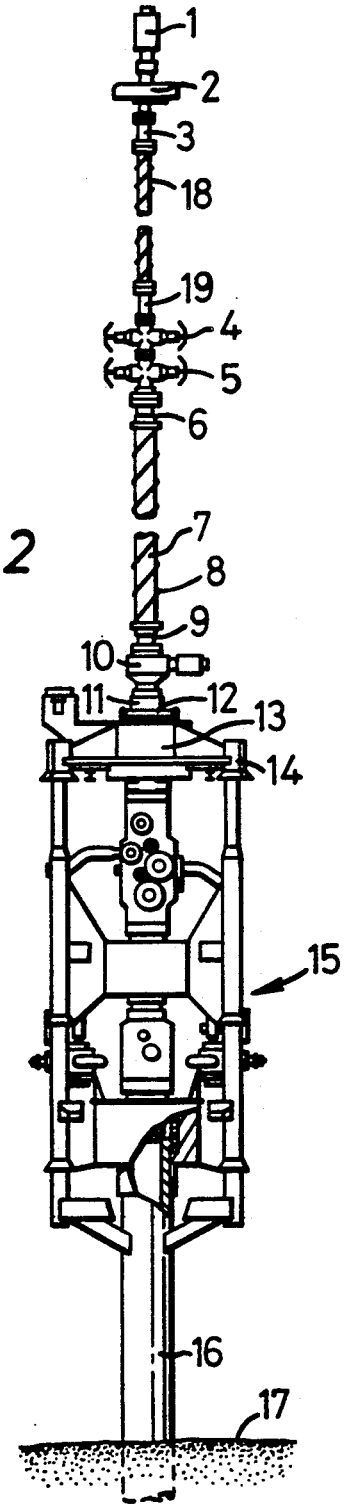

The invention is illustrated with reference to FIGS. 1 and 2 of the accompanying drawings wherein FIG. 1 is an elevation of a lubricator and FIG. 2 shows the lubricator, with the addition of a fishing section, mounted on a subsea Christmas tree.

With reference to the Figures, subsea wireline lubricator comprises a hydraulically latched stuffing box 1 connected via an adapter spool 3 to blind and shear ram-type blow-out preventers 4 and 5. A lifting bar 2 provides the means for handling the lubricator.

The blow-out preventers 4 and 5 lead through an adapter spool 6 to the riser 7, which is in effect the storage receptacle for equipment entering or leaving the well. The riser 7 comprises an inner pressure contained tube through which wireline access is gained, and an outer structural casing. The riser 7 is surrounded by helical strakes 8. These act as vortex shedders when the tool is deployed in waters in which strong currents flow, and therefore reduce vibration of the tool.

The base of the riser 7 is connected by way of an adapter spool 9 to a rotatable foot valve 10, a cross-over spool 11, a clamp connector 12 and an hydraulic connector 13 held in a guide frame 14.

FIG. 2 shows the above assembly fitted to the top of the well head Christmas tree 15 mounted on a conductor 16 leading to a reservoir below the sea bed 17.

The lubricator is located by means of posts of the tree 15 passing through the guide frame 14 and by the hydraulic connector 13 attaching to the wellhead.

A fishing section comprising an upper riser 18, dimensioned to accommodate a fishing tool, and an adapter spool 19 is located between the lifting bar 2 and the blow-out preventer 4. The riser 18 is fitted with strakes which serve the same purpose as those on the riser 7.

Control of the lubricator and Christmas tree, which is being accessed, is via an hydraulic umbilical (not shown) which connects to the Christmas tree via a conventional pod and receptacle arrangement and to the lubricator via a breakaway connection mounted on the guide frame. In severe weather conditions the control umbilical may be retrieved leaving the lubricator and wellhead in a safe condition.

Hydraulic and flushing lines for the control functions above the riser section are run in the annulus between the inner tube and outer casing of the riser 7.

We claim:

1. A method for inserting wireline equipment into a subsea oil well utilizing a subsea wireline lubricator comprising in sequence a stuffing box for axial marine entry of a wireline tool, at least one blow-out preventer, a riser, a foot valve and a connector for connection to a subsea well head assembly, said method comprising the steps of (a) connecting the subsea wireline lubricator to the wellhead, (b) closing the foot valve, (c) opening the stuffing box, (d) opening the blow-out preventer, (e) inserting the equipment through the stuffing box and the blow-out preventer into the riser directly from the sea in the wet, (f) closing the stuffing box, (g) pressure testing, (h) opening the foot valve and (i) lowering the equipment through the foot valve and into the well.

* * * * *